US007618306B2

(12) United States Patent
Felipe, Sr. et al.

(10) Patent No.: US 7,618,306 B2
(45) Date of Patent: Nov. 17, 2009

(54) CONFORMABLE ABRASIVE ARTICLES AND METHODS OF MAKING AND USING THE SAME

(75) Inventors: Peter A. Felipe, Sr., St. Paul, MN (US); James W. Schutz, Woodbury, MN (US); Gregory A. Koehnle, Oakdale, MN (US); Michael J. Annen, Hudson, WI (US); Albert I. Everaerts, Oakdale, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 309 days.

(21) Appl. No.: 11/232,834

(22) Filed: Sep. 22, 2005

(65) Prior Publication Data

US 2007/0066185 A1 Mar. 22, 2007

(51) Int. Cl.
*B24B 7/22* (2006.01)
*B24D 3/22* (2006.01)

(52) U.S. Cl. ..... 451/28; 451/533

(58) Field of Classification Search ..... 451/539, 451/538, 533, 526, 523, 490, 508, 921, 28
See application file for complete search history.

(56) References Cited

U.S. PATENT DOCUMENTS

| | | | | |
|---|---|---|---|---|
| 526,137 | A * | 9/1894 | Winslow | 15/230.19 |
| 2,871,218 | A | 1/1959 | Schollenberger | |
| 2,958,593 | A | 11/1960 | Hoover et al. | |
| 3,041,156 | A | 6/1962 | Rowse et al. | |
| 3,270,467 | A | 9/1966 | Block et al. | |
| 3,541,736 | A | 11/1970 | Takekawa | |
| 3,562,968 | A | 2/1971 | Johnson et al. | |
| 3,645,835 | A | 2/1972 | Hodgson | |
| 3,667,170 | A | 6/1972 | MacKay, Jr. | |
| 4,055,029 | A | 10/1977 | Kalbow | |
| 4,055,897 | A | 11/1977 | Brix | |
| 4,314,827 | A | 2/1982 | Leitheiser et al. | |
| 4,588,419 | A | 5/1986 | Caul et al. | |
| 4,595,001 | A | 6/1986 | Potter et al. | |
| 4,598,004 | A | 7/1986 | Heinecke | |
| 4,609,581 | A | 9/1986 | Ott | |

(Continued)

FOREIGN PATENT DOCUMENTS

| | | | |
|---|---|---|---|
| CN | 1140380 | C | 3/2004 |

(Continued)

OTHER PUBLICATIONS

Fritz et al., "Abrasive Articles, and Methods of Making and Using the Same", U.S. Appl. No. 10/828,119, filed Apr. 20, 2004.

(Continued)

*Primary Examiner*—Robert Rose
(74) *Attorney, Agent, or Firm*—Bradford B. Wright

(57) ABSTRACT

Conformable abrasive article comprising: a backing having a first major surface; a deformable material contacting a central portion of the first major surface; an elastic member affixed to the first major surface of the backing and together with the backing enclosing the deformable material; and an abrasive member affixed to the elastic member, wherein the abrasive member comprises abrasive particles and a binder; and methods of making and using the same.

6 Claims, 3 Drawing Sheets

U.S. PATENT DOCUMENTS 4,623,364 A 11/1986 Cottringer et al.
4,734,104 A 3/1988 Broberg
4,737,163 A 4/1988 Larkey
4,744,802 A 5/1988 Schwabel
4,751,138 A 6/1988 Tumey et al.
4,770,671 A 9/1988 Monroe et al.
4,881,951 A 11/1989 Wood et al.
4,927,431 A 5/1990 Buchanan et al.
RE33,353 E 9/1990 Heinecke
4,962,562 A * 10/1990 Englund et al. ..... 15/230.16
4,985,340 A 1/1991 Palazzotto et al.
4,997,461 A 3/1991 Markhoff-Matheny et al.
5,007,128 A 4/1991 Englund et al.
5,009,675 A 4/1991 Kunz et al.
5,011,508 A 4/1991 Wald et al.
5,014,468 A 5/1991 Ravipati et al.
5,042,991 A 8/1991 Kunz et al.
5,078,753 A 1/1992 Broberg et al.
5,085,671 A 2/1992 Martin et al.
5,088,483 A 2/1992 Heinecke
5,152,917 A 10/1992 Pieper et al.
5,160,315 A 11/1992 Heniecke et al.
5,203,884 A 4/1993 Buchanan et al.
5,213,591 A 5/1993 Celikkaya et al.
5,254,194 A 10/1993 Ott et al.
5,304,223 A 4/1994 Pieper et al.
5,366,523 A 11/1994 Rowenhorst et al.
5,378,251 A 1/1995 Culler et al.
5,383,309 A 1/1995 Sampietro
5,390,449 A * 2/1995 Hilton ..... 451/526
5,396,737 A 3/1995 Englund et al.
5,417,726 A 5/1995 Stout et al.
5,435,816 A 7/1995 Spurgeon et al.
5,436,063 A 7/1995 Follett et al.
5,454,844 A 10/1995 Hibbard et al.
5,490,878 A 2/1996 Peterson et al.
5,491,015 A 2/1996 Reeves et al.
5,496,386 A 3/1996 Broberg et al.
5,520,711 A 5/1996 Helmin
5,520,957 A 5/1996 Bange et al.
5,549,962 A 8/1996 Holmes et al.
5,551,960 A 9/1996 Christianson
5,593,769 A 1/1997 Wolf et al.
5,609,706 A 3/1997 Benedict et al.
5,658,184 A 8/1997 Hoopman et al.
5,664,989 A 9/1997 Nakata et al.
5,672,097 A 9/1997 Hoopman
5,672,186 A 9/1997 Chesley et al.
5,681,217 A 10/1997 Hoopman et al.
5,692,950 A 12/1997 Rutherford et al.
5,700,302 A 12/1997 Stoetzel et al.
5,766,277 A 6/1998 DeVoe et al.
5,785,784 A 7/1998 Chesley et al.
5,851,247 A 12/1998 Stoetzel et al.
5,910,471 A 6/1999 Christianson et al.
5,913,716 A 6/1999 Mucci et al.
5,928,760 A 7/1999 Usui et al.
5,931,727 A 8/1999 Schadow
5,942,015 A 8/1999 Culler et al.
5,954,844 A 9/1999 Law et al.
5,958,794 A 9/1999 Bruxvoort et al.
5,961,674 A 10/1999 Gagliardi et al.
5,975,988 A 11/1999 Christianson
5,980,143 A 11/1999 Bayer et al.
5,994,450 A 11/1999 Pearce
6,004,363 A 12/1999 Pisacane et al.
6,013,711 A 1/2000 Lewis et al.
6,059,850 A 5/2000 Lise et al.
6,077,601 A 6/2000 DeVoe et al.
6,139,594 A 10/2000 Kincaid et al.
D438,095 S 2/2001 Berger
6,183,346 B1 2/2001 Gagliardi
6,183,677 B1 2/2001 Usui et al.
D438,784 S 3/2001 Berger
6,228,133 B1 5/2001 Thurber et al.
6,231,629 B1 5/2001 Christianson et al.
6,251,493 B1 6/2001 Johnson et al.
6,261,682 B1 7/2001 Law
6,277,160 B1 8/2001 Stubbs et al.
6,375,559 B1 4/2002 James et al.
6,439,979 B1 * 8/2002 Beppu et al. ..... 451/285
6,458,018 B1 10/2002 Goers et al.
6,544,306 B2 4/2003 Suzuki et al.
6,613,113 B2 9/2003 Minick et al.
6,626,403 B1 9/2003 Wolf et al.
6,632,129 B2 10/2003 Goetz
6,634,929 B1 10/2003 Visser
6,663,477 B1 12/2003 Gee
6,722,952 B2 4/2004 Goers et al.
6,767,492 B2 7/2004 Norquist et al.
6,797,765 B2 9/2004 Pearce
6,838,589 B2 1/2005 Liedtke et al.
6,908,979 B2 6/2005 Arendoski
6,923,840 B2 8/2005 Schutz et al.
6,929,539 B2 8/2005 Schutz et al.
6,986,706 B1 * 1/2006 Cooper et al. ..... 451/527
2001/0041511 A1 11/2001 Lack et al.
2002/0019199 A1 2/2002 Goers et al.
2002/0090891 A1 7/2002 Adefris et al.
2002/0090901 A1 7/2002 Schutz et al.
2003/0022604 A1 1/2003 Annen et al.
2003/0049995 A1 3/2003 Schutz et al.
2003/0143938 A1 7/2003 Braunschweig et al.
2003/0150169 A1 8/2003 Annen
2003/0207659 A1 11/2003 Annen et al.
2004/0192177 A1 9/2004 Carpenter
2005/0020189 A1 1/2005 Annen et al.
2005/0020190 A1 1/2005 Schutz et al.

FOREIGN PATENT DOCUMENTS

EP 0 306 161 A2 3/1989
EP 0 306 162 B1 3/1989
JP 10-006207 1/1998
JP 11-019855 1/1999
JP 2001-293652 10/2001
WO WO 02/076678 A1 10/2002

OTHER PUBLICATIONS

Schutz et al., "Flexible Abrasive Article and Method of Making and Using the Same", U.S. Appl. No. 11/179,175, filed Jul. 12, 2005.
Annen et al., "Flexible Abrasive Article and Methods of Making and Using the Same", U.S. Appl. No. 11/233,250, filed Sep. 22, 2005.

* cited by examiner

CONFORMABLE ABRASIVE ARTICLES AND METHODS OF MAKING AND USING THE SAME

BACKGROUND

In order to protect and preserve the aesthetic qualities of the finish on an automobile or other vehicle, it is generally known to provide a clear (non-pigmented or slightly pigmented) topcoat over a colored (pigmented) basecoat, so that the basecoat remains unaffected even during prolonged exposure to the environment or weathering. Generally in the art, this is known as a basecoat/topcoat or basecoat/clearcoat finish. Typically, the basecoat is applied over a primer coat. During application of each of these coats, or during repair thereof, nibs, protrusions or other defects may occur which aesthetically detract from the appearance of the finish.

Removal of such defects (commonly referred to as "de-nibbing") is currently accomplished by abrading methods that are typically slow and tedious, and may result in flat spots in the characteristic orange-peel appearance of areas of the clear coat that are adjacent to nibs that are removed. To overcome this change in appearance, a technician may be required to repair a full body panel, instead of repairing the individual defects.

More generally, the same issues of blending the surface appearance are also of at least aesthetic importance in many other conventional abrading processes such as, for example, those processes involving coated abrasive products.

SUMMARY

In one aspect, the present invention provides a conformable abrasive article comprising:

a backing having a first major surface;

a deformable material contacting a central portion of the first major surface, the deformable material having greatest thickness proximal to the center of the first major surface;

an elastic member affixed to the first major surface of the backing and together with the backing enclosing the deformable material; and an abrasive member affixed to the elastic member, wherein the abrasive member comprises abrasive particles and a binder.

In another aspect, the present invention provides a method of making a conformable abrasive article comprising:

providing a backing having a first major surface;

contacting a deformable material with a central portion of the first major surface of the backing, the deformable material having greatest thickness proximal to the center of the first major surface;

affixing an elastic member to the first major surface of the backing, the elastic member and the compressible backing enclosing the deformable material; and affixing an abrasive member to the elastic member, wherein the abrasive member comprises abrasive particles and a binder.

In another aspect, the present invention provides a method of making a conformable abrasive article comprising:

providing a backing having a first major surface;

contacting a deformable material with a central portion of the first major surface of the backing, the deformable material having greatest thickness proximal to the center of the first major surface;

affixing an elastic member to the first major surface of the backing, the elastic member and the compressible backing enclosing the deformable material; and applying a curable composition comprising a polymerizable binder precursor and abrasive particles to the extensible tie layer; and at least partially curing the curable composition to provide an abrasive layer.

In some embodiments, the backing comprises a flexible member having a compressible foam layer affixed thereto, wherein the flexible member has a surface that comprises the second major surface of the backing, and wherein the compressible foam layer has a surface that comprises the first major surface of the backing.

In some embodiments, the elastic member comprises a conformable elastomeric film affixed to an elastomeric foam, wherein the conformable elastomeric film is further affixed to the first major surface of the backing.

Conformable abrasive articles according to the present invention are useful, for example, for abrading a workpiece. For example, the present invention provides a nib-removal system that achieves the desired effect of nib removal with little or no perceptible damage to the appearance of the clear coat surface around the nib, and resulting in considerable savings in time, labor, and materials.

As used herein:

"compressible" means reducible in volume by at least 10 percent by applied mechanical force without substantial crushing or fusing;

"conformable" means capable of adjusting shape in response to an applied mechanical force;

"thickness" of the conformable abrasive article is determined as the distance from the second major surface of the backing to the outermost surface of the abrasive layer.

DETAILED DESCRIPTION

Conformable abrasive articles according to the present invention have a backing having a first major surface; a deformable material contacting a central portion of the first major surface, the deformable material having greatest thickness proximal to the center of the first major surface; an elastic member affixed to the first major surface of the backing. Together, the elastic member and the backing envelope the deformable material. An abrasive member is affixed to the elastic member such that the abrasive layer is at least outwardly disposed.

Figure 1:
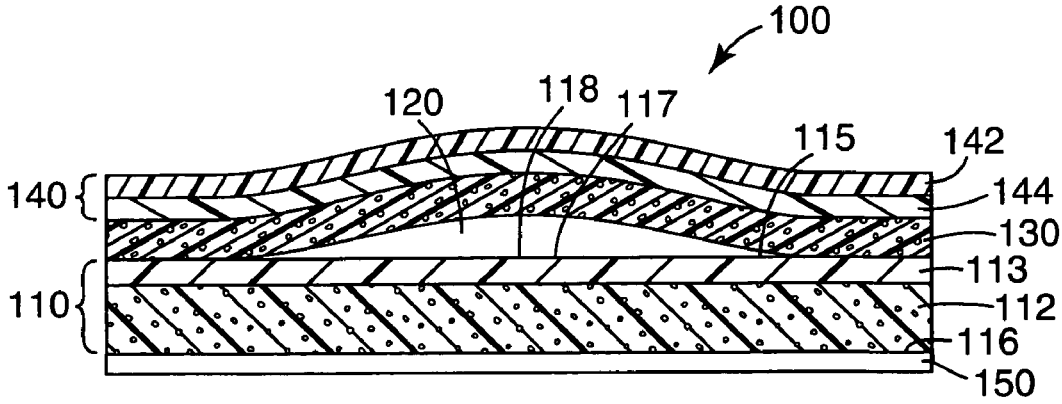
FIG. 1 is a cross-sectional schematic view of an exemplary conformable abrasive article according to one embodiment of the present invention.

One exemplary embodiment of a conformable abrasive article is shown in FIG. 1. Referring now to FIG. 1, which is not drawn to scale, conformable abrasive article 100 comprises compressible backing 110 having first and second major surfaces 115, 116. Deformable material 120 contacts a central portion 117 of first major surface 115, and has its greatest thickness proximal to the center 118 of first major surface 115. Compressible backing 110 comprises foam 112 and optional polymeric film 113 affixed to foam 112. Elastic member 130 is affixed to first major surface 115 of compressible backing 110, and together with compressible backing 110, encloses deformable material 120. Abrasive member 140, which comprises abrasive layer 142 and optional flexible backing 144, is affixed to elastic member 130. Optional attachment system 150 is affixed to second major surface 116 of compressible backing 110.

Figure 2:
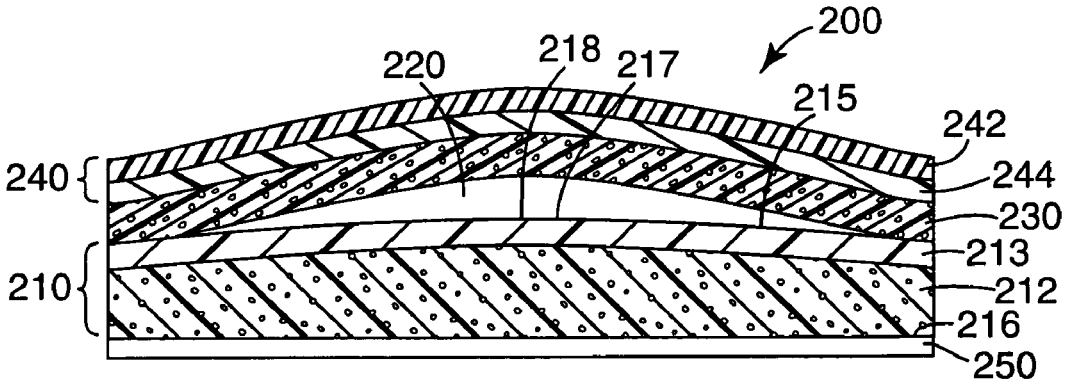
FIG. 2 is a cross-sectional schematic view of another exemplary conformable abrasive article according to one embodiment of the present invention.

Another exemplary embodiment, shown not to scale in FIG. 2 conformable abrasive article 200 comprises compressible backing 210 having first and second major surfaces 215, 216. Deformable material 220 contacts a central portion 217 of first major surface 215, and has its greatest thickness proximal to the center 218 of first major surface 215. Compressible backing 210 comprises foam 212 and optional polymeric film 213 affixed to foam 212. Elastic member 230 is affixed to first major surface 215 of compressible backing 210, and together with compressible backing 210, encloses deformable material 220. Abrasive member 240, which comprises abrasive layer 242 and optional flexible backing 244, is affixed to elastic member 230. Optional attachment system 250 is affixed to second major surface 216 of compressible backing 210. In this embodiment, each of the compressible backing 210, elastic member 230, the optional flexible backing 244, are curved and abrasive layer 242 is outwardly convex.

Figure 3:
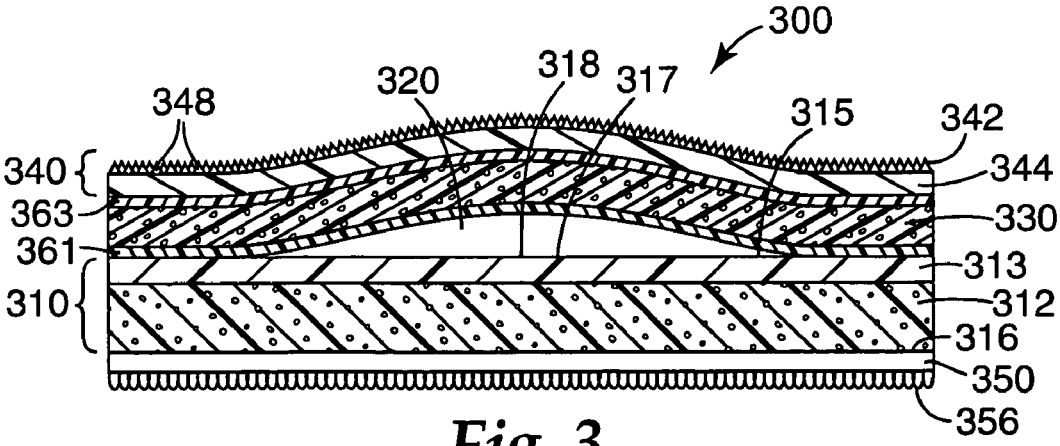
FIG. 3 is a cross-sectional schematic view of another exemplary conformable abrasive article according to one embodiment of the present invention.

Another exemplary embodiment of a conformable abrasive article is shown in FIG. 3. Referring now to FIG. 3, which is not drawn to scale, conformable abrasive article 300 comprises compressible backing 310 having first and second major surfaces 315, 316. Deformable material 320 contacts a central portion 317 of first major surface 315, and has its greatest thickness proximal to the center 318 of first major surface 315. Compressible backing 310 comprises foam 312 and optional polymeric film 313 affixed to foam 312. Elastic member 330 is affixed to optional first elastomeric film 361, which in turn is affixed to first major surface 315 of compressible backing 310, and together with compressible backing 310, encloses deformable material 320. Abrasive member 340, which comprises abrasive layer 342 and optional flexible backing 344, is affixed to optional second elastomeric film 363, which in turn is affixed to elastic member 330. Abrasive layer 342 comprises an array of shaped abrasive composite particles 348. Optional attachment system 350, optionally having loops 356, is affixed to second major surface 316 of compressible backing 310.

Figure 4:
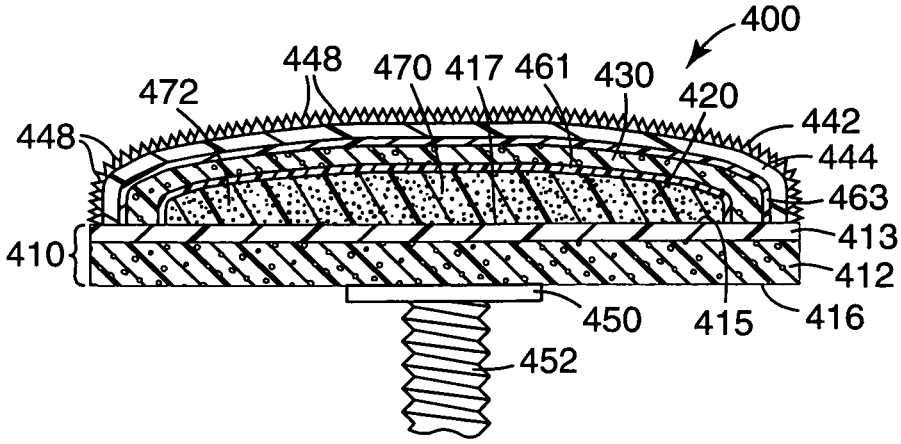
FIG. 4 is a cross-sectional schematic view of another exemplary conformable abrasive article according one embodiment of the present invention.

Another exemplary embodiment of a conformable abrasive article is shown in FIG. 4. Referring now to FIG. 4, which is not drawn to scale, conformable abrasive article 400 comprises compressible backing 410 having first and second major surfaces 415, 416. Deformable material 420 contacts central portion 417 of first major surface 415, and has central region 470 of substantially uniform thickness and a peripheral region 472 of decreasing thickness. Compressible backing 410 comprises foam 412 and optional polymeric film 413 affixed to foam 412. Elastic member 430 is affixed to optional first elastomeric film 461, which in turn is affixed to first major surface 415 of compressible backing 410, and together with compressible backing 410, encloses deformable material 420. Abrasive member 440 (not shown), which comprises abrasive layer 442 and optional flexible backing 444, is affixed to optional second elastomeric film 463, which in turn is affixed to elastic member 430. Abrasive layer 442 comprises an array of shaped abrasive composite particles 448. Optional attachment system 450 with threaded fastener 452, is affixed to second major surface 416 of compressible resilient backing 410. In this embodiment, compressible backing 410 is substantially planar, while elastic member 430, optional flexible backing 444, are curved, and abrasive layer 442 is outwardly convex.

Backing

The backing may comprise any rigid or resilient and/or compressible material(s). The degree of flexibility of the backing will typically vary with the intended use.

For example, in some embodiments, the backing may comprise a rigid plate or flange (e.g., a molded polymeric or metal plate or flange). Optionally, the backing in these embodiments may have an integral or affixed mechanical fastener, for example as described hereinbelow.

In some embodiments, the backing may comprise a compressible resilient nonwoven web, optionally in combination with one or more thin synthetic polymeric films affixed thereto.

Useful nonwoven webs include, for example, open fiber webs (e.g., lofty open fiber webs) wherein the fibers are bonded together in their mutual contact points by a binder (e.g., formed by drying and/or curing a binder precursor material). The nonwoven web may be made, for example, from an air-supported construction (e.g., as described in U.S. Pat. No. 2,958,593 (Hoover et al.)), from a carded and cross-lapped construction, or a meltblown construction. Useful fibers include natural and synthetic fibers, and blends thereof. Useful synthetic fibers include, for example, those fibers made of polyester (for example, polyethylene-terephthalate), high or low resilience nylon (for example, hexamethylene-adipamide, polycaprolactam), polypropylene, acrylic (formed from acrylonitrile polymer), rayon, cellulose acetate, chloride copolymers of vinyl-acrylonitrile, and others. The appropriate natural fibers include those coming from cotton, wool, jute, and hemp.

Fibers diameters may be, for example, less than or equal to 1, 2, 4, 6, 10, 13, 17, 70, 110, 120 or 200 denier, although this is not a requirement. Fiber webs basis weights will depend upon the web thickness and the degree of openness.

Examples of suitable binder precursor materials include latexes (e.g., acrylic latexes or polyurethane latexes), phenolic resins, aminoplast resins, polymer plastisols, and combinations thereof.

The non-woven web is typically formed and then coated with a binder precursor then submitted to a coating procedure in which a curable binder precursor is applied to the web, e.g., by roll coating, dip coating, or spraying.

In some embodiments, the backing comprises at least one compressible foam layer, optionally in combination with one or more flexible members (e.g., polymeric films) affixed thereto. In general, in these embodiments, any foam layer with at least one coatable major surface may be used. The foam layer may comprise any compressible foam material. In some embodiments, the compressible foam material is elastic. Useful foams include elastic foams such as, for example, chloroprene rubber foams, ethylene/propylene rubber foams, butyl rubber foams, polybutadiene foams, polyisoprene foams, EPDM polymer foams, polyurethane foams, ethylene-vinyl acetate foams, neoprene foams, and styrene/butadiene copolymer foams. Useful foams also include thermoplastic foams such as, for example, polyethylene foams, polypropylene foams, polybutylene foams, polystyrene foams, polyamide foams, polyester foams, plasticized polyvinyl chloride (i.e., pvc) foams. The foam layer may be of an open cell or closed cell variety, although typically, if the abrasive article is intended for use with liquids, an open cell foam having sufficient porosity to permit the entry of liquid is desirable. Particular examples of useful open cell foams are polyester polyurethane foams, commercially available from Illbruck, Inc., Minneapolis, Minn. under the trade designations "R 200U", "R 400U", "R 600U" and "EF3-700C".

In those embodiments wherein the compressible backing comprises a foam layer, the thickness of the compressible foam layer is typically in a range of from 1 to 50 millimeters, however, other thickness may also be used. Typically, the bulk density of the compressible foam layer as determined by ASTM D-3574 is greater than about 0.03 gram per $cm^3$ (2 lbs per $ft^3$), however lower density foam layers may also be used. In some embodiments, the foam layer has a bulk density of about 0.03 to about 0.10 grams per $cm^3$ (1.8-6 lbs per $ft^3$). While thinner or thicker and/or lighter or heavier foams may be useful, they may require special handling because they are somewhat more difficult to process on conventional coating equipment.

The compressible backing is typically in sheet form with substantially parallel major surfaces, but other surface-configurations with one or both major surfaces being planar or other than planar are also useful. For example, in those embodiments wherein the compressible backing comprises a foam layer, the second major surface may be planar to facilitate attachment and the first major surface, i.e., the surface may be other than planar, such as an undulated or convoluted surface. Convoluted foams are disclosed in U.S. Pat. Nos. 5,007,128 and 5,396,737 (both to Englund et al.), the disclosures of which are incorporated herein by reference.

In those embodiments wherein the compressible backing comprises a foam layer, the foam layer may have an elongation in a range of from about 85 to about 150% (i.e., the stretched length of the foam minus the unstretched length of the foam all divided by the unstretched length of the foam and then multiplied by 100 equals 85 to 150%.).

Deformable Material

The deformable material contacts a central portion of, and has its greatest thickness proximal to, the center of the first major surface of the backing. The deformable material may comprise gas (e.g., air), liquid (e.g., water, oil), foam (e.g., as described hereinabove), semi-solid gel or paste, or a combination thereof. The deformable material may be enclosed within a polymeric bladder.

In some embodiments, the deformable material comprises an elastomer. For example, the deformable material may comprise, or even consist essentially of, at least one elastomeric gel or foamed elastomeric gel, typically comprising a highly plasticized elastomer. Examples of useful elastomeric gels include polyurethane elastomer gels, e.g., as described in U.S. Pat. No. 6,908,979 (Arendoski); SEEPS elastomer gels, e.g., as described in U.S. Pat. Nos. 5,994,450 and 6,797,765 (both to Pearce); styrene-butadiene-styrene/oil gels; and silicone elastomer gels, e.g., as described in U.S. Pat. No. 6,013,711 (Lewis et al.), the disclosures of which are incorporated herein by reference.

For solid and gel materials, the elastic modulus (measured at 1 Hz and 25° C.) for the deformable material is between about 1500 and about $4.9\times10^5$ Pascals (Pa), for example, between about 1750 and about $1\times10^5$ Pa, although this is not a requirement. Examples of such deformable materials include styrene-butadiene-styrene/oil gels (e.g., having an elastic modulus of 1992 Pa at 1 Hz and 25° C.), urethane foam (e.g., having an elastic modulus of $3.02\times10^5$ Pa at 1 Hz and 25° C. or $4.31\times10^5$ Pa at 1 Hz and 25° C.); and elastomeric urethane rubber (e.g., having modulus $4.89\times10^5$ Pa at 1 Hz and 25° C.).

The deformable material may be of any shape such as, for example, geometric shapes such as domes, curves, cones, truncated cones, ridges, polyhedrons, truncated polyhedrons, or other shapes (e.g., yurt-shaped). The deformable material may also be ridged (e.g., along the longest dimension of the first major surface of the compressible backing) as, for example, in the case of rectangular pads or belts.

The deformable material may contact from as little as about 0.1, 5, 10, 20, 30, 40 or 50 percent up to 60, 70, 80, 90, or even 99.9 percent of the first major surface of the compressible backing. For example, the deformable material may contact at least one half of the major surface of the compressible backing.

Typically, the maximum thickness of the deformable material is selected based on factors such as, for example, the intended use and the overall size of the conformable abrasive article. In some embodiments, the maximum thickness of the deformable material is in a range of from about 25 micrometers to about 0.5 centimeter.

Elastic Member

The elastic member is a layer of material that provides a degree of flexibility and resiliency to the abrasive article, while enclosing the deformable material between itself and the compressible backing.

In some embodiments, the elastic member comprises an elastomeric film. The elastomeric film may be a uniform film, or it may be a composite film (e.g., having multiple layers produced by coextrusion, heat lamination, or adhesive bonding). Examples of elastomers that may be used in the elastomeric film include polyolefin, polyester (e.g., those available under the trade designation "HYTREL" from E.I. du Pont de Nemours& Co., Wilmington, Del.), polyamide, styrene/butadiene copolymer (e.g., those available under the trade designation "KRATON" from Kraton Polymers, Houston Tex.), and polyurethane elastomers (e.g., those polyurethane elastomers available under the trade designation "ESTANE 5701" and "ESTANE 5702"; chloroprene rubber, ethylene/propylene rubbers, polybutadiene rubber, polyisoprene rubber, natural or synthetic rubber, butyl rubber, silicone rubber, or EPDM rubber; and combinations thereof. Examples of useful elastomeric films include those described in U.S. Pat. No. 2,871,218 (Schollenberger); U.S. Pat. No. 3,645,835 (Hodgson); U.S. Pat. No. 4,595,001 (Potter et al.); U.S. Pat. No. 5,088,483 (Heinecke); U.S. Pat. No. 6,838,589 (Liedtke et al.); and RE33353 (Heinecke), the disclosures of which are incorporated herein by reference. Also useful are pressure sensitive adhesive coated polyurethane elastomer films, commercially available from 3M Company under the trade designation "TEGADERM".

In some embodiments the elastic member comprises resilient foam. For example, the elastic member may comprise a composite of an elastomeric film affixed to elastomeric foam. Useful resilient elastomeric foams include, for example, chloroprene rubber foams, ethylene/propylene rubber foams, butyl rubber foams, polybutadiene foams, polyisoprene foams, EPDM polymer foams, polyurethane foams, ethylene-vinyl acetate foams, neoprene foams, and styrene/butadiene copolymer foams.

Affixing may be accomplished, for example, by an adhesive (e.g., hot melt or pressure sensitive), by coextrusion, by heat laminating, or any other suitable method. In such embodiments, either of the elastomeric film or the elastomeric foam, for example, may be affixed to the first major surface of the backing.

The elastic member may contain additives such as, for example, stabilizers, fillers, pigments, processing aids, and the like.

The elastic member may be affixed to the backing by any suitable means including, for example, hot melt adhesives, pressure sensitive adhesives, glues, and heat laminating or bonding. In some embodiments, affixing may be achieved using a pressure sensitive transfer adhesive such as, for example, that marketed by 3M Company under the trade designation "HS300LSE".

Typically, the thickness for the elastic layer is in a range from about 0.01 millimeters to about 3.5 millimeters, for example, in a range of from 0.02 to 3.2 millimeters, or in a range of from 0.02 to 1.7 millimeters, although other thicknesses may also be used.

Typically, the elastic modulus (measured at 1 Hz and 25° C.) of the elastic member is between about $2.4\times10^5$ and about $7\times10^5$ Pascals, for example, between about $3\times10^5$ and about $6\times10^5$ Pascals, or even between about $4\times10^5$ and about $5\times10^5$ Pascals, although this is not a requirement.

Alternatively, or in addition to the optional tie layer the elastic member may be surface treated by corona, flame or acid or base priming.

Abrasive Member

The abrasive member comprises an abrasive layer, optionally affixed to a flexible backing (i.e., a coated abrasive article). The optional flexible backing may be elastic.

Figure 5A:
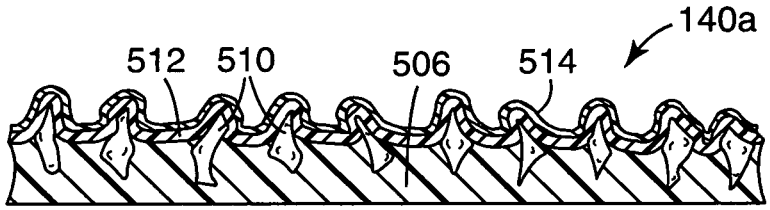
FIGS. 5A-5C are enlarged schematic cross-sectional views of various embodiments of abrasive layers.

In some embodiments, the abrasive layer comprises make and size layers and abrasive particles as shown for example, in FIG. 5A. Referring now to FIG. 5A, abrasive layer 140*a* comprises make layer 506, abrasive particles 510, size layer 512, and optional supersize 514. Useful make, size, and optional supersize layers, flexible coated abrasive articles, and methods of making the same according to these embodiments include, for example, those described in U.S. Pat. No. 4,588,419 (Caul et al.); U.S. Pat. No. 4,734,104 (Broberg); U.S. Pat. No. 4,737,163 (Larkey); U.S. Pat. No. 4,751,138 (Tumey et al.); U.S. Pat. No. 5,078,753 (Broberg et al.); U.S. Pat. No. 5,203,884 (Buchanan et al.); U.S. Pat. No. 5,152,917 (Pieper et al.); U.S. Pat. No. 5,378,251 (Culler et al.); U.S. Pat. No. 5,366,523 (Rowenhorst et al.); U.S. Pat. No. 5,417,726 (Stout et al.); U.S. Pat. No. 5,436,063 (Follett et al.); U.S. Pat. No. 5,490,878 (Peterson et al.); U.S. Pat. No. 5,496,386 (Broberg et al.); U.S. Pat. No. 5,609,706 (Benedict et al.); U.S. Pat. No. 5,520,711 (Helmin); U.S. Pat. No. 5,954,844 (Law et al.); U.S. Pat. No. 5,961,674 (Gagliardi et al.); U.S. Pat. No. 4,751,138 (Tumey et al.); U.S. Pat. No. 5,766,277 (DeVoe et al.); U.S. Pat. No. 6,059,850 (Lise et al.); U.S. Pat. No. 6,077,601 (DeVoe et al.); U.S. Pat. No. 6,228,133 (Thurber et al.); and U.S. Pat. No. 5,975,988 (Christianson); the disclosures of which are incorporated herein by reference, and those marketed by 3M Company under the trade designations "260L IMPERIAL FINISHING FILM".

Figure 5B:
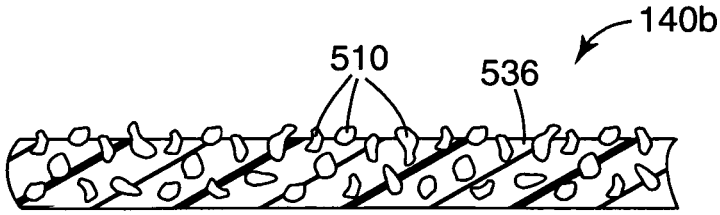

In other embodiments, the abrasive layer comprises abrasive particles in a binder, typically substantially uniformly distributed throughout the binder, as shown for example, in FIG. 5B. Referring now to FIG. 5B, abrasive layer 140*b* comprises binder 536 and abrasive particles 510. Details concerning materials and methods for making such abrasive layers may be found, for example, in U.S. Pat. No. 4,927,431 (Buchanan et al.); U.S. Pat. No. 5,014,468 (Ravipati et al.); U.S. Pat. No. 5,378,251 (Culler et al.); U.S. Pat. No. 5,942,015 (Culler et al.); U.S. Pat. No. 6,261,682 (Law); and U.S. Pat. No. 6,277,160 (Stubbs et al.); and U.S. Pat. Appln. Publ. Nos. 2003/0207659 A1 (Annen et al.) and 2005/0020190 A1 (Schutz et al.); the disclosures of which are incorporated herein by reference.

In those embodiments wherein the abrasive member has no backing, a slurry of abrasive particles in a binder precursor may be applied directly to the elastic member, and then at least partially cured. Examples of useful flexible coated abrasive articles of this embodiment include those described in U.S. Pat. No. 6,929,539 (Schutz et al.), the disclosure of which is incorporated herein by reference.

Figure 5C:
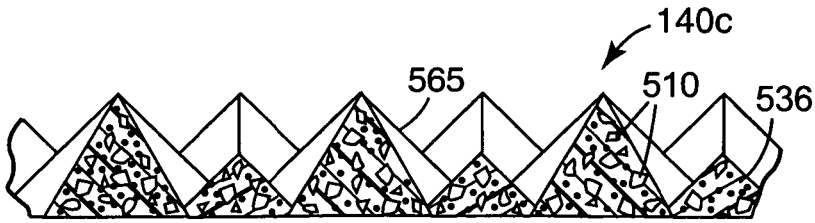

In some embodiments, the abrasive layer comprises a structured abrasive layer, for example, as described in FIG. 5C. Referring now to FIG. 5C, structured abrasive layer 140*c* comprises precisely shaped abrasive composites 565. Precisely shaped abrasive composites 565 comprise abrasive particles 510 dispersed throughout binder 536.

In the embodiments shown in FIGS. 5A-5C, the abrasive layer may contact the elastic member, or if present, the optional flexible backing.

Structured abrasive members, useful in practice of the present invention, generally have an abrasive layer comprising a plurality of non-randomly shaped abrasive composites, optionally supported on a flexible backing, and affixed to the elastic member. As used herein, the term "abrasive composite" refers to a body that includes abrasive particles and a binder. In some embodiments, shaped abrasive composites may be arranged according to a predetermined pattern (e.g., as an array).

In some embodiments, at least a portion of the shaped abrasive composites may comprise "precisely shaped" abrasive composites. This means that the shape of the abrasive composites is defined by relatively smooth surfaced sides that are bounded and joined by well-defined edges having distinct edge lengths with distinct endpoints defined by the intersections of the various sides. The terms "bounded" and "boundary" refer to the exposed surfaces and edges of each composite that delimit and define the actual three-dimensional shape of each abrasive composite. These boundaries are readily visible and discernible when a cross-section of an abrasive article is viewed under a scanning electron microscope. These boundaries separate and distinguish one precisely shaped abrasive composite from another even if the composites abut each other along a common border at their bases. By comparison, in an abrasive composite that does not have a precise shape, the boundaries and edges are not well defined (e.g., where the abrasive composite sags before completion of its curing). Typically, precisely shaped abrasive composites are arranged on the backing according to a predetermined pattern or array, although this is not a requirement.

Shaped abrasive composites may be arranged such that some of their work surfaces are recessed from the polishing surface of the abrasive layer.

Suitable optional flexible backings include flexible backings used in the abrasive art such as, for example, flexible polymeric films (including primed polymeric films and elastomeric polymeric films), elastomeric cloth, thin polymeric foam, and combinations thereof. Examples of suitable flexible polymeric films include polyester films, polypropylene films, polyethylene films, ionomer films (e.g., those available under the trade designation "SURLYN" from E.I. du Pont de Nemours & Co., Wilmington, Del.), vinyl films, polycarbonate films, and laminates thereof.

Structured abrasive members may be prepared by forming a slurry of abrasive particles and a solidifiable or polymerizable precursor of the abovementioned binder resin (i.e., a binder precursor), contacting the slurry with a backing member (or directly with the elastic member), and solidifying and/or polymerizing the binder precursor (e.g., by exposure electromagnetic radiation or thermal energy) in a manner such that the resulting structured abrasive article has a plurality of shaped abrasive composites affixed to the backing member.

Examples of energy sources include thermal energy and radiant energy (including electron beam, ultraviolet light, and visible light).

In some embodiments the slurry may be coated directly onto a production tool having precisely shaped cavities therein and brought into contact with the backing, or coated on the backing and brought to contact with the production tool. In this embodiment, the slurry is typically then solidified or cured while it is present in the cavities of the production tool. U.S. Pat. No. 6,929,539 (Schutz et al.), the disclosure of which is incorporated herein by reference, describes such procedures.

Precisely shaped abrasive composites may be of any three-dimensional shape that results in at least one of a raised feature or recess on the exposed surface of the abrasive layer. Useful shapes include, for example, cubic, prismatic, pyramidal (e.g., square pyramidal or hexagonal pyramidal), truncated pyramidal, conical, frusto-conical, pup tent shaped, and ridge shaped. Combinations of differently shaped and/or sized abrasive composites may also be used. The abrasive layer of the structured abrasive may be continuous or discontinuous.

For fine finishing applications, the density of shaped abrasive composites in the abrasive layer is typically in a range of from at least 1,000, 10,000, or even at least 20,000 abrasive composites per square inch (e.g., at least 150, 1,500, or even 7,800 abrasive composites per square centimeter) up to and including 50,000, 70,000, or even as many as 100,000 abrasive composites per square inch (up to and including 7,800, 11,000, or even as many as 15,000 abrasive composites per square centimeter), although greater or lesser densities of abrasive composites may also be used.

Further details concerning structured abrasive member having precisely shaped abrasive composites, and methods for their manufacture may be found, for example, in U.S. Pat. No. 5,152,917 (Pieper et al.); U.S. Pat. No. 5,304,223 (Pieper et al.); U.S. Pat. No. 5,435,816 (Spurgeon et al.); U.S. Pat. No. 5,672,097 (Hoopman); U.S. Pat. No. 5,681,217 (Hoopman et al.); U.S. Pat. No. 5,454,844 (Hibbard et al.); U.S. Pat. No. 5,549,962 (Holmes et al.); U.S. Pat. No. 5,700,302 (Stoetzel et al.); U.S. Pat. No. 5,851,247 (Stoetzel et al.); U.S. Pat. No. 5,910,471 (Christianson et al.); U.S. Pat. No. 5,913,716 (Mucci et al.); U.S. Pat. No. 5,958,794 (Bruxvoort et al.); U.S. Pat. No. 6,139,594 (Kincaid et al.); U.S. Pat. No. 6,923,840 (Schutz et al.); and U.S. Pat. Appln. Nos. 2003/00226.04 (Annen et al.); the disclosures of which are incorporated herein by reference.

Structured abrasive members having precisely shaped abrasive composites that are useful for practicing the present invention are commercially available as films and/or discs, for example, as marketed under the trade designation "3M TRIZACT FINESSE-IT" by 3M Company, Saint Paul, Minn. Examples include "3M FINESSE-IT TRIZACT FILM, 466LA" available in grades A7, A5 and A3. Structured abrasive members having larger abrasive composite sizes may also be useful for practicing the present invention, for example, those marketed under the trade designation "TRIZACT CF", available from 3M Company.

Structured abrasive members may also be prepared by coating a slurry comprising a polymerizable binder precursor, abrasive particles, and an optional silane coupling agent through a screen that is in contact with a backing. In this embodiment, the slurry is typically then further polymerized (e.g., by exposure to an energy source) while it is present in the openings of the screen thereby forming a plurality of shaped abrasive composites generally corresponding in shape to the screen openings. Further details concerning this type of screen coated structured abrasive may be found, for example, in U.S. Pat. No. 4,927,431 (Buchanan et al.); U.S. Pat. No. 5,378,251 (Culler et al.); U.S. Pat. No. 5,942,015 (Culler et al.); U.S. Pat. No. 6,261,682 (Law); and U.S. Pat. No. 6,277,160 (Stubbs et al.); the disclosures of which are incorporated herein by reference.

In some embodiments, a slurry comprising a polymerizable binder precursor, abrasive particles, and an optional silane coupling agent may be deposited on a backing in a patterned manner (e.g., by screen or gravure printing), partially polymerized to render at least the surface of the coated slurry plastic but non-flowing, a pattern embossed upon the partially polymerized slurry formulation, and subsequently further polymerized (e.g., by exposure to an energy source) to form a plurality of shaped abrasive composites affixed to the backing. Such embossed structured abrasive articles prepared by this and related methods are described, for example, in U.S. Pat. Appl. Pub. No. 2001/0041511 (Lack et al.), the disclosure of which is incorporated herein by reference. Commercially available examples of such embossed structured abrasive articles are believed to include abrasive belts and discs available from Norton-St. Gobain Abrasives Company, Worcester, Mass., under the trade designation "NORAX" such as for example, "NORAX U264-X80", "NORAX U266-X30", "NORAX U264-X80", "NORAX U264-X45", "NORAX U254-X45, X30", "NORAX U264-X16", "NORAX U336-X5" and "NORAX U254-AF06".

Structured abrasive layers may be prepared by coating a slurry comprising a polymerizable binder precursor, abrasive particles, and an optional silane coupling agent through a screen that is in contact with the elastic member, which may optionally have a tie layer or surface treatment thereon. In this embodiment, the slurry is typically then further polymerized (e.g., by exposure to an energy source such as heat or electromagnetic radiation) while it is present in the openings of the screen thereby forming a plurality of shaped abrasive composites generally corresponding in shape to the screen openings. Further details concerning this type of screen coated structured abrasive may be found, for example, in U.S. Pat. No. 4,927,431 (Buchanan et al.); U.S. Pat. No. 5,378,251 (Culler et al.); U.S. Pat. No. 5,942,015 (Culler et al.); U.S. Pat. No. 6,261,682 (Law); and U.S. Pat. No. 6,277,160 (Stubbs et al.); and in U.S. Publ. Pat. Appl. No. 2001/0041511 (Lack et al.); the disclosures of which are incorporated herein by reference.

Useful polymerizable binder precursors that may be cured to form the above-mentioned binders are well-known and include, for example, thermally curable resins and radiation curable resins, which may be cured, for example, thermally and/or by exposure to radiation energy. Exemplary polymerizable binder precursors include phenolic resins, aminoplast resins, urea-formaldehyde resins, melamine-formaldehyde resins, urethane resins, polyacrylates (e.g., an aminoplast resin having pendant free-radically polymerizable unsaturated groups, urethane acrylates, acrylate isocyanurate, (poly) acrylate monomers, and acrylic resins), alkyd resins, epoxy resins (including bis-maleimide and fluorene-modified epoxy resins), isocyanurate resins, allyl resins, furan resins, cyanate esters, polyimides, and mixtures thereof. Polymerizable binder precursors may contain one or more reactive diluents (e.g., low viscosity monoacrylates) and/or adhesion promoting monomers (e.g., acrylic acid or methacrylic acid).

If either ultraviolet radiation or visible radiation is to be used, the polymerizable binder precursor typically further comprise a photoinitiator.

Examples of photoinitiators that generate a free radical source include, but are not limited to, organic peroxides, azo compounds, quinones, benzophenones, nitroso compounds, acyl halides, hydrazones, mercapto compounds, pyrylium compounds, triacrylimidazoles, bisimidazoles, phosphene oxides, chloroalkyltriazines, benzoin ethers, benzil ketals, thioxanthones, acetophenone derivatives, and combinations thereof Cationic photoinitiators generate an acid source to initiate the polymerization of an epoxy resin. Cationic photoinitiators can include a salt having an onium cation and a halogen containing a complex anion of a metal or metalloid. Other cationic photoinitiators include a salt having an organometallic complex cation and a halogen containing complex anion of a metal or metalloid. These are further described in U.S. Pat. No. 4,751,138, incorporated herein by reference. Another example of a cationic photoinitiator is an organometallic salt and an onium salt described in U.S. Pat. No. 4,985,340; European Patent Applications 306,161 and 306,162; all of which are incorporated herein by reference. Still other cationic photoinitiators include an ionic salt of an organometallic complex in which the metal is selected from the elements of Periodic Group IVB, VB, VIB, VIIB and VIIIB.

The polymerizable binder precursor may also comprise resins that are curable by sources of energy other than radiation energy, such as condensation curable resins. Examples of such condensation curable resins include phenolic resins, melamine-formaldehyde resins, and urea-formaldehyde resins.

The binder precursor and binder may include one or more optional additives selected from the group consisting of grinding aids, fillers, wetting agents, chemical blowing agents, surfactants, pigments, coupling agents, dyes, initiators, energy receptors, and mixtures thereof. The optional additives may also be selected from the group consisting of potassium fluoroborate, lithium stearate, glass bubbles, inflatable bubbles, glass beads, cryolite, polyurethane particles, polysiloxane gum, polymeric particles, solid waxes, liquid waxes and mixtures thereof.

Abrasive particles useful in the present invention can generally be divided into two classes: natural abrasives and manufactured abrasives. Examples of useful natural abrasives include: diamond, corundum, emery, garnet (off-red color), buhrstone, chert, quartz, garnet, emery, sandstone, chalcedony, flint, quartzite, silica, feldspar, natural crushed aluminum oxide, pumice and talc. Examples of manufactured abrasives include: boron carbide, cubic boron nitride, fused alumina, ceramic aluminum oxide, heat treated aluminum oxide (both brown and dark grey), fused alumina zirconia, glass, glass ceramics, silicon carbide (preferably green, although small amounts of black may be tolerated), iron oxides, tantalum carbide, chromia, cerium oxide, tin oxide, titanium carbide, titanium diboride, synthetic diamond, manganese dioxide, zirconium oxide, sol gel alumina-based ceramics, silicon nitride, and agglomerates thereof. Examples of sol gel abrasive particles can be found in U.S. Pat. No. 4,314,827 (Leitheiser et al.); U.S. Pat. No. 4,623,364 (Cottringer et al); U.S. Pat. No. 4,744,802 (Schwabel); U.S. Pat. No. 4,770,671 (Monroe et al.) and U.S. Pat. No. 4,881,951 (Wood et al.), all incorporated herein by reference.

The size of an abrasive particle is typically specified to be the longest dimension of the abrasive particle. In most cases there will be a range distribution of particle sizes. The particle size distribution may be tightly controlled such that the resulting abrasive article provides a consistent surface finish on the workpiece being abraded, however, broad and/or polymodal particle size distributions may also be used.

The abrasive particle may also have a shape associated with it. Examples of such shapes include rods, triangles, pyramids, cones, solid spheres, hollow spheres and the like. Alternatively, the abrasive particle may be randomly shaped.

Abrasive particles can be coated with materials to provide the particles with desired characteristics. For example, materials applied to the surface of an abrasive particle have been shown to improve the adhesion between the abrasive particle and the polymer. Additionally, a material applied to the surface of an abrasive particle may improve the adhesion of the abrasive particles in the softened particulate curable binder material. Alternatively, surface coatings can alter and improve the cutting characteristics of the resulting abrasive particle. Such surface coatings are described, for example, in U.S. Pat. No. 5,011,508 (Wald et al.); U.S. Pat. No. 3,041,156 (Rowse et al.); U.S. Pat. No. 5,009,675 (Kunz et al.); U.S. Pat. No. 4,997,461 (Markhoff-Matheny et al.); U.S. Pat. No. 5,213,591 (Celikkaya et al.); U.S. Pat. No. 5,085,671 (Martin et al.) and U.S. Pat. No. 5,042,991 (Kunz et al.); the disclosures of which are incorporated herein by reference.

In some embodiments, for example, those including shaped abrasive composites, the abrasive particles have a particle size ranging from about 0.1 micrometer to about 1500 micrometers, more typically ranging from about 0.1 micrometer to about 1300 micrometers. In some embodiments, the abrasive particles have a size within a range of from JIS grade 800 (14 micrometers at 50% midpoint) to JIS grade 4000 (3 micrometers at 50% midpoint) or even JIS grade 6000 (2 micrometers at 50% midpoint), inclusive.

Typically, the abrasive particles used in the present invention have a Moh's hardness of at least 8, more typically above 9; however, abrasive particles having a Moh's hardness of less than 8 may be used.

If the abrasive member has an optional flexible backing, it may be affixed to the elastic member by any suitable means including, for example, hot melt adhesives, pressure sensitive adhesives (e.g., latex pressure sensitive adhesives or pressure sensitive adhesive transfer films), glue, heat lamination, or coextrusion.

Attachment System

Conformable abrasive articles according to the present invention may be secured to a support structure, commonly referred to as a backup pad. The conformable abrasive article may be secured by means of, for example, a pressure sensitive adhesive, hook and loop attachment, or some other mechanical means.

Accordingly, conformable abrasive articles according to the present invention may further comprise an attachment system affixed to the second major surface of the backing. The attachment system is typically designed to secure the conformable abrasive article to a tool (optionally having a back up pad mounted thereto) such as, for example, a rotary sander.

In one embodiment, the attachment system comprises a layer of pressure sensitive adhesive, typically made by applying a layer of pressure sensitive adhesive to the second major surface of the backing. Useful pressure sensitive adhesives for this layer include, for example, those derived from acrylic polymers and copolymers (e.g., polybutyl acrylate), vinyl ethers (e.g., polyvinyl n-butyl ether); vinyl acetate adhesives; alkyd adhesives; rubber adhesives (e.g., natural rubber, synthetic rubber, chlorinated rubber); and mixtures thereof. One preferred pressure sensitive adhesive is an isooctyl acrylate: acrylic acid copolymer. The pressure sensitive adhesive may be coated out of organic solvent, water or be coated as a hot melt adhesive.

In another embodiment, the attachment system comprises a quick connect mechanical fastener such as, for example, those described in U.S. Pat. No. 3,562,968 (Johnson et al.); U.S. Pat. No. 3,667,170 (Mackay, Jr.); U.S. Pat. No. 3,270,467; and U.S. Pat. No. 3,562,968 (Block et al.); and in commonly assigned U.S. Ser. No. 10/828,119 (Fritz et al.), filed Apr. 20, 2004; the disclosures of which are incorporated herein by reference.

In yet another embodiment, the attachment system comprises a loop substrate. The purpose of the loop substrate is to provide a means that the conformable abrasive article can be securely engaged with hooks from a support pad. The loop substrate may be laminated to the coated abrasive backing by any conventional means. The loop substrate may be a chenille stitched loop, a stitchbonded loop substrate or a brushed loop substrate (e.g., brushed nylon). Examples of typical loop backings are further described in U.S. Pat. Nos. 4,609,581 and 5,254,194 (both to Ott), the disclosures of which are incorporated herein by reference. The loop substrate may also contain a sealing coat to seal the loop substrate and prevent subsequent coatings from penetrating into the loop substrate.

In yet another embodiment, the attachment system comprises an intermeshing attachment system. An example of such an attachment system may be found in U.S. Publ. Pat. Appln. No. 2003/0143938 (Braunschweig et al.), the disclosure of which is incorporated herein by reference.

Likewise, the back side of the abrasive article may contain a plurality of hooks; these hooks are typically in the form of sheet like substrate having a plurality of hooks protruding therefrom, for example, as described in U.S. Pat. No. 5,672,186 (Chesley et al.), the disclosure of which is incorporated herein by reference. These hooks will then provide the engagement between the coated abrasive article and a support pad that contains a loop fabric. This hook substrate may be laminated to the coated abrasive backing by any conventional means.

Method of Making

Conformable abrasive articles according to the present invention may generally be made by: providing a backing with first and second opposed major surfaces; and contacting a deformable material with a central portion of the first major surface of the backing such that the deformable material has greatest thickness proximal to the center of the first major surface; affixing an elastic member to the first major surface of the backing such that the backing and the backing envelope the deformable material; and affixing an abrasive member to the elastic member, wherein the abrasive member comprises abrasive particles in a binder. The surface of the elastic member may be surface treated to enhance adhesion as discussed hereinabove.

Affixing of the various components may be accomplished by any suitable means such as, for example, an adhesive (e.g., hot melt or pressure sensitive), glue, mechanical fasteners, coextrusion, by heat and/or pressure laminating, or any other suitable method.

Useful adhesives include, for example, acrylic pressure sensitive adhesive, rubber-based pressure sensitive adhesives, waterborne lattices, solvent-based adhesives, and two-part resins (e.g., epoxies, polyesters, or polyurethanes). Examples of suitable pressure sensitive adhesives include those derived from acrylate polymers (for example, polybutyl acrylate) polyacrylate esters), acrylate copolymers (for example, isooctyl acrylate/acrylic acid), vinyl ethers (for example, polyvinyl n-butyl ether); alkyd adhesives; rubber adhesives (for example, natural rubbers, synthetic rubbers and chlorinated rubbers); and mixtures thereof. An example of a pressure sensitive adhesive coating is described in U.S. Pat. No. 5,520,957 (Bange et al.), the disclosure of which is incorporated herein by reference.

Adhesives may be applied by any suitable means including, for example, roll coating, brushing, extrusion, spraying, bar coating, and knife coating.

The deformable material may be applied to the backing by any suitable means including, for example, manually, by mechanical device, and/or by extrusion.

When enclosing the deformable material with the elastic member, or optional elastomeric film, care should typically be taken to ensure a continuous seal with the backing.

The abrasive member is then affixed to the elastic member, for example, by affixing the flexible backing to the elastic member or coating a slurry comprising binder precursor and abrasive particles onto the elastic member and at least partially curing the binder precursor as described herein above.

Abrasive Articles

Figure 6:
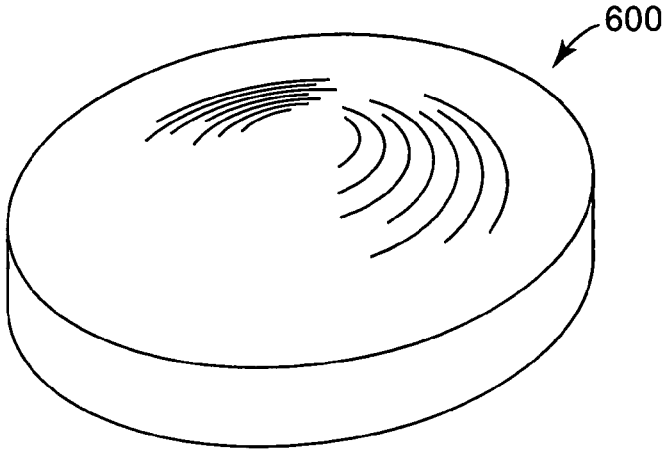
FIG. 6 is a perspective view of an exemplary conformable abrasive pad according to one embodiment of the present invention.
Figure 7:
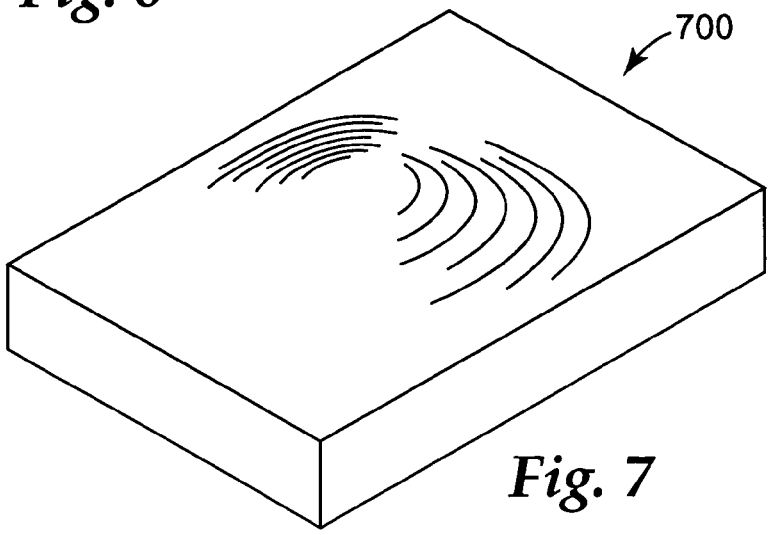
FIG. 7 is a perspective view of an exemplary conformable abrasive pad according to one embodiment of the present invention.
Figure 8:
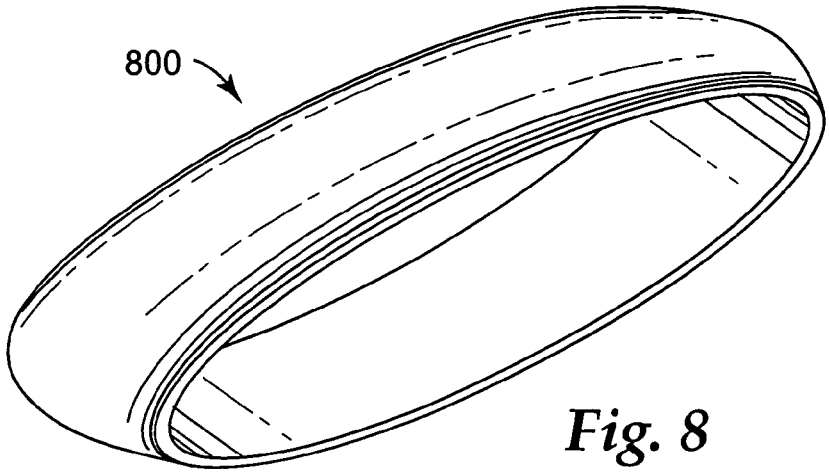
FIG. 8 is a perspective view of an exemplary conformable abrasive belt according to one embodiment of the present invention.

Conformable abrasive articles according to the present invention may be manufactured to have any form. Specific examples include a circular abrasive pad (shown as 600 in FIG. 6), a rectangular abrasive pad (shown as 700 in FIG. 7), or an abrasive belt (shown as 800 in FIG. 8).

Conformable abrasive articles may be used, for example, by hand or in combination with a power tool such as for example, a rotary sander or belt sander.

Conformable abrasive articles according to the present invention are useful for abrading (including finishing) a workpiece by a method that includes: providing a conformable abrasive article according to the present invention; frictionally contacting at least one abrasive particle with a workpiece; and moving at least one of the abrasive particle and the workpiece relative to the other to abrade at least a portion of the surface of the workpiece. For example, the abrasive article may oscillate at the abrading interface during use.

The workpiece can be any of a variety of types of material such as painted substrates (e.g., having a clear coat, base (color) coat, primer or e-primer), coated substrates (e.g., with polyurethane, lacquer, etc.), plastics (thermoplastic, thermosetting), reinforced plastics, metal, (carbon steel, brass, copper, mild steel, stainless steel, titanium and the like) metal alloys, ceramics, glass, wood, wood-like materials, composites, stones (including gem stones), stone-like materials, and combinations thereof. The workpiece may be flat or may have a shape or contour associated with it. Examples of common workpieces that may be polished by the abrasive article of the invention include metal or wooden furniture, painted or unpainted motor vehicle surfaces (car doors, hoods, trunks, etc.), plastic automotive components (headlamp covers, taillamp covers, other lamp covers, arm rests, instrument panels, bumpers, etc.), flooring (vinyl, stone, wood and wood-like materials), counter tops, and other plastic components.

During abrading processes it may be desirable to provide a liquid to the surface of the workpiece and/or the abrasive layer. The liquid may comprise water and/or an organic compound, and additives such as defoamers, degreasers, liquids, soaps, corrosion inhibitors, and the like.

Without wishing to be bound by theory, it is believed that during abrading abrasive articles according to the present invention are typically compressed causing deformation of the deformable material which then redistributes the compression force toward the periphery of the abrasive article, minimizing excessive downward force on the centermost region of the abrasive crown, and resulting in a smoother transition in the appearance of the abraded surface of a workpiece than would be typically observed using a corresponding conventional abrasive article that did not include a cushion of deformable material as in the present invention.

Objects and advantages of this invention are further illustrated by the following non-limiting examples, but the particular materials and amounts thereof recited in these examples, as well as other conditions and, details, should not be construed to unduly limit this invention.

EXAMPLES

Unless otherwise noted, all parts, percentages, ratios, etc. in the examples and the rest of the specification are by weight, and all reagents used in the examples were obtained, or are available, from general chemical suppliers such as, for example, Sigma-Aldrich Company, Saint Louis, Mo., or may be synthesized by conventional methods.

The following abbreviations are used throughout the Examples:

GC1: antioxidant commercially available under the trade designation "IRGANOX 1010" from Ciba Specialty Chemicals, Tarrytown, N.Y.

GC2: butadiene-styrene block copolymer commercially available under the trade designation "KRATON D1107" from Kraton Polymers, Houston, Tex.

GC3: white mineral oil

PM1: 2-phenoxyethyl acrylate monomer available under the trade designation "SR 339" from Sartomer Company, Exton, Pa.

PM2: trimethylolpropane triacrylate available under the trade designation "SR 351" from Sartomer Company.

PM3: a polymeric dispersant available under the trade designation "SOLPLUS D520" from Noveon, Inc., Cleveland, Ohio.

PM4: gamma-methacryloxypropyltrimethoxy silane resin modifier available under the trade designation "SILQUEST A174" from Witco Corporation, Greenwich, Conn.

PM5: ethyl 2,4,6-trimethylbenzoylphenylphosphinate photoinitiator available under the trade designation "LUCIRIN TPO-L" from BASF Corp., Charlotte, N.C.

PM6: silicon dioxide available under the trade designation "AEROSIL OX-50" from Degussa Corp., Dusseldorf, Germany.

MNI: a grade JIS 1000 silicon carbide abrasive mineral, commercially available under the trade designation "GC1000" from Fujimi Corp., Elmhurst, Ill.

MN2: a grade JIS 2000 silicon carbide abrasive mineral, commercially available under the trade designation "GC2000" from Fujimi Corp.

MN3: a grade JIS 3000 silicon carbide abrasive mineral, commercially available under the trade designation "GC3000" from Fujimi Corp.

MN4: a grade JIS 4000 silicon carbide abrasive mineral, commercially available under the trade designation "GC4000" from Fujimi Corp.

MN5: a grade JIS1500 silicon carbide abrasive mineral, commercially available under the trade designation "GC1500" from Fujimi Corp.

Preparation of Abrasive Slurries AS1-AS5

A resin pre-mix was made by mixing for 30 minutes at 20° C., 63.12 grams of PM1, 63.12 grams of PM2, 18.04 grams of PM3, 13.53 grams of PM4 and 13.55 grams of PM5. PM6 (22.54 grams) was then added and the mixing continued until homogeneous.

Abrasive slurries AS1-AS4 (as reported in Table 1, below) were made by combining 257 grams of the following minerals to 193 grams of the resin pre-mix, then combined for 5 minutes on a high speed shear mixer until homogeneous.

TABLE 1

| ABRASIVE SLURRY | MINERAL |
|---|---|
| AS1 | MN1 |
| AS2 | MN2 |
| AS3 | MN3 |
| AS4 | MN4 |
| AS5 | MN5 |

The temperature during the high speed mixing step was kept below 100° F. (37.8° C.). AS1 was applied via knife coating to a polypropylene production tool having a uniform pattern, as disclosed in U.S. Pat. No. 6,929,539 (Schutz et al.). The slurry coated polypropylene production tool was brought into contact with 3 mil ethylene-acrylic acid primed polyester film such that the slurry contacted the polyester film. The production tool was then irradiated with an ultraviolet (UV) lamp, type "D" bulb, from Fusion Systems Inc., Gaithersburg, Md., at 600 Watts per inch (236 Watts per cm) while moving the web at 30 feet per minute (9.14 meters/minute), and a nip pressure of 90 pounds per square inch (620.5 kilopascals (kPa)) for a 10 inch (25.4 cm) wide web. The production tool was removed from the resulting substantially cured shaped abrasive coating on the film laminated backing. Discs of 1.25 inch (3.2 cm) diameter and designated AD1, were then die cut from the resulting abrasive material. This process was then repeated to make abrasive discs AD2, AD3, AD4 and AD5 from abrasive slurries AS2, AS3, AS4 and AS5 respectively.

Example 1

A gel composition was prepared by mixing in a glass jar at 20° C. until homogeneous, 1.2 parts by weight GC1, 12.4 parts by weight GC2 and 86.4 parts by weight GC3. The mixture was then heated with a heat gun to render it pourable. The heated gel was placed into a mold with a dome-shaped recess 1.27 cm in diameter and 1.2 mm deep at the center, and allowed to cool for 10 minutes to form a gel body. The gel body was then placed in the center of a 1.25-inch (3.2 cm) sanding pad, commercially available under the trade designation "FINESSE-IT ROLOC SANDING PAD, PART No. 02345" from 3M Company. The gel-filled body was secured to the sanding pad with a 2 inch by 2 inch (5.1 by 5.1 cm) piece of 0.8 mils (20.3 micrometers (μm)) of an adhesively coated elastomeric polyurethane transfer film, commercially available under the trade designation "TEGADERM", from 3M Company, with the excess film wrapped over the edge of the sanding pad. A 1.25-inch (3.2 cm) diameter by 31.25 mils (793.8 μm) thick piece of another elastomeric polyurethane film, commercially available under the trade designation "BUMPON PROTECTIVE PRODUCT 6200 SERIES ROLLSTOCK", from 3M Company, was applied over the TEGADERM film. The remaining exposed adhesive perimeter of the TEGADERM film was then covered with a strip of vinyl tape commercially available under the trade designation "VINYL TAPE, NO. 471" from 3M Company. Abrasive disc AD1 was then secured to the surface of the "BUMPON" film.

Example 2

The process described above was repeated, except that abrasive disc AD1 was replaced with abrasive disc AD2.

Example 3

The process described above was repeated, except that abrasive disc AD1 was replaced with abrasive disc AD3.

Example 4

The process described above was repeated, except that abrasive disc AD1 was replaced with abrasive disc AD4.

Example 5

A layer of transfer adhesive commercially available under the trade designation "HS300LSE" from 3M Company, was laminated to the non-adhesive, exposed face of the "TEGADERM" transfer film. AS5 was applied via knife coating to a polypropylene production tool having a uniform pattern, as disclosed in U.S. Pat. No. 6,929,539. The slurry coated polypropylene production tool was brought into contact with the elastomeric polyurethane transfer film such that the slurry contacted the exposed layer of the "HS300LSE" transfer adhesive. The production tool was then irradiated with an ultraviolet (UV) lamp, type "D" bulb, from Fusion Systems Inc., Gaithersburg, Md., at 600 Watts per inch (236 Watts per cm) while moving the web at 30 feet per minute (9.14 meters/minute), and a nip pressure of 90 pounds per square inch (620.5 kilopascals (kPa)) for a 10 inch (25.4 cm) wide web. The production tool was removed from the resulting substantially cured shaped abrasive coating on the elastomeric polyurethane film.

A 2 inch (5.1 cm) wide strip of the "471" vinyl tape was applied to both ends and both lengths of a sanding sponge, commercially available under the trade designation "SMALL AREA SANDING SPONGE, TYPE 907NA", from 3M Company. The tape was applied around the perimeter of the sanding sponge such that ⅛ inch (3.2 mm) of tape was exposed above one side of the sponge, thereby forming a mold. The gel composition described in Example 1 was prepared and poured into the mold and allowed to cool for 10 minutes.

The gel was pulled down and secured onto the sanding sponge with a 4-inch×4-inch (10-cm by 10-cm) piece of the "TEGADERM" transfer film. The film was wrapped over the edges of the sanding pad. An area measuring 2.5 inches×2.5 inches (6.4 cm by 6.4 cm) was created over this layer with 0.5-inch (1.27-cm) foam tape, commercially available under the trade designation "SOFT EDGE FOAM MASKING TAPE, PART NO. 06297." This created another cavity for additional gel. The aforementioned gel was prepared and poured into the mold and allowed to cool for 10 minutes, thereby creating a centered raised portion 6.4 cm×6.4 cm×0.3 cm high. The gel was pulled down and secured onto the sanding sponge with a 4-inch×4-inch (10.2-cm by 10.2-cm) piece of "TEGADERM" transfer film. The film was then wrapped over the edges of the sanding pad. The release liner was removed from the abrasive-coated elastomeric polyurethane film described above, and the resulting abrasive-coated free film was pulled down and secured on to the hand pad, such that the exposed adhesive contacted the hand pad and the abrasive coating was the exposed layer on the resulting abrasive hand pad.

Example 6

A 2-inch (5.1-cm) wide strip of the "471" vinyl tape was applied around circumference of a 6 inches (15.2 cm) in diameter hand pad, commercially available under the trade designation "3M HOOKIT II SOFT HAND PAD, PART No. 05291." The tape was applied such that ⅛ inch (3.2 mm) of tape was exposed around the circumference, thereby forming a dam to create a volume into which gel can be poured. The gel composition described in Example 1 was prepared and poured into the resulting mold and allowed to cool for 10 minutes. The abrasive-coated elastomeric polyurethane film of Example 5 was similarly applied to the gel face of the hand pad.

Example 7

Foam masking tape, (1.27 cm in width, commercially available under the trade designation "SOFT EDGE FOAM MASKING TAPE" from 3M Company, was used to form a channel on a 1.27 cm wide×45.7 cm long abrasive belt, commercially available under the trade designation available "237AA" from 3M Company. The belt was folded in half and held level on a silicone liner with the foam masking tape. The gel composition described in Example 1 was prepared and poured into the resulting mold and allowed to cool for 10 minutes. This procedure was repeated until the entire outer surface of the belt contained an approximately 3-mm thick layer of gel. The abrasive-coated elastomeric polyurethane film of Example 5 was similarly applied to the gel face of the belt.

Testing

Abrasive articles were tested for their ability to remove dirt nibs in automotive clearcoat without concomitant leveling of the surrounding orange peel. The sanding substrates were 18-inch by 24-inch (45.7-cm by 61-cm) clear coated black painted cold roll steel test panels, obtained from ACT Laboratories, Inc., Hillsdale, Mich., as the sanding substrate. The panels were then scuffed to ensure mechanical paint adhesion using "TRIZACT HOOKIT II BLENDING DISC, 443SA, GRADE P1000" commercially available from 3M Company, attached to a random orbit sander, model number "59025" obtained from Dynabrade, Inc., Clarence, N.Y., operating at a line pressure of 40 pounds per square inch (258 kilopascals (kPa)). The panels were scuffed by sanding around the edges of the panel first, then sanding the entire panel with an up/down motion and then side-to-side motion. The panels had a matte finish when this step was complete. The panels were wiped down with a dry paper towel to remove most of the wet swarf. The panels were then washed with general purpose adhesive cleaner (commercially available under the trade designation "3M General Purpose Adhesive Cleaner" from 3M Company), Part No. 051135-08984.

A clearcoat solution was prepared by mixing together 3 parts of resin (available under the trade designation "CHROMA CLEAR G2 4500S"), 1 part activator (available under the trade designation "62-4508S") and 1 part reducer (available under the trade designation "12375S"), all commercially available from E.I. du Pont de Nemours & Co., Wilmington, Del. The clearcoat was applied to the panel using a spray gun, model NR 95 from SATA Farbspritztechnik GmbH, Kornwestheim, Germany with 1.3-mm spray nozzle operating at a line pressure of 40 pounds per square inch (258 kilopascals (kPa)). The clearcoat solution was sprayed onto each panel at a nominal thickness of 2 mils (50 micrometers). The panels were allowed to dry at room temperature in air for at least 24 hours 5 days before use.

Abrasive testing was done using a 3.2-cm random orbit sander, model number "57502" obtained from Dynabrade, Inc., Clarence, N.Y., operating at a line pressure of 40 pounds per square inch (258 kilopascals (kPa)). Dirt nibs in the cured clearcoat were identified visually. The abrasive article was attached to the sander and tested by damp-sanding a given nib for between 2 and 6 seconds at a time, depending on the abrasive grade. The nib was sanded with the center of the abrasive article using the weight of the tool to generate the down force. The sanded area was polished using a Dewalt Buffer model no. 849, commercially available from Dewalt Industrial Tool, Hampstead, Md., operating at 1400 rotations per minute (rpm). The buffing used a machine glaze (available under the trade designation "PERFECT-IT III TRIZACT MACHINE GLAZE", Part No. 05718), a backup pad (available under the trade designation (available under the trade designation "PERFECT-IT BACK UP PAD", Part No. 05725) and a polishing pad (available under the trade designation "PERFECT-IT FOAM POLISHING PAD", Part No. 05930), all commercially available from 3M Company. The average surface finish ($R_Z$) in micrometers (μm) of each sanded spot was measured using a profilometer available under the trade designation "SURTRONIC 3+ PROFILOMETER" from Taylor Hobson, Inc., Leicester, England. $R_Z$ is the average of 5 individual measurements of the vertical distance between the highest point and the lowest point over the sample length of an individual profilometer measurement. Two finish measurements were made per sanded spot.

The abrasive articles of Examples 1 through 4 were tested by the procedure outlined above, and the results are reported in Table 2 (below).

TABLE 2

| Sample | Nib Removed | Orange Peel Leveled | Average $R_Z$ (micrometers) | Sanding time to remove the nib (seconds) |
|---|---|---|---|---|
| Example 1 | Yes | No | 0.68 | 2 |
| Example 2 | Yes | No | 0.43 | 4 |
| Example 3 | Yes | No | 0.36 | 4 |
| Example 4 | Yes | No | 0.33 | 5 |

Various modifications and alterations of this invention may be made by those skilled in the art without departing from the scope and spirit of this invention, and it should be understood that this invention is not to be unduly limited to the illustrative embodiments set forth herein.

What is claimed is:

1. A conformable abrasive article comprising:

a backing having first and second opposed major surfaces;

an attachment system affixed to the second major surface;

a deformable material contacting a central portion of the first major surface, the deformable material having greatest thickness proximal to the center of the first major surface;

an elastic member affixed to the first major surface of the backing and together with the backing enclosing the deformable material; and an abrasive member affixed to the elastic member, wherein the abrasive member comprises abrasive particles and a binder, wherein the abrasive member comprises a flexible backing member having an abrasive layer affixed thereto, wherein the abrasive layer comprises abrasive composite particles, the abrasive composite particles comprising the abrasive particles dispersed in the binder, and wherein the backing member is affixed to the elastic member, wherein the abrasive composite particles are precisely shaped.

2. A conformable abrasive article comprising:

a backing having first and second opposed major surfaces;

an attachment system affixed to the second major surface;

a deformable material contacting a central portion of the first major surface, the deformable material having greatest thickness proximal to the center of the first major surface;

an elastic member affixed to the first major surface of the backing and together with the backing enclosing the deformable material; and an abrasive member affixed to the elastic member, wherein the abrasive member comprises abrasive particles and a binder, wherein the backing comprises a flexible member having a compressible foam layer affixed thereto, wherein the flexible member has a surface that comprises a second major surface of the backing, and wherein the compressible foam layer has a surface that comprises the first major surface of the backing.

3. A conformable abrasive article according to claim 2, wherein the compressible foam layer is elastic.

4. A conformable abrasive article according to claim 2, wherein the flexible member comprises a polymeric film.

5. A method of abrading a workpiece, the method comprising:

providing a conformable abrasive article according to claim 2;

frictionally contacting at least one abrasive particle with a workpiece; and moving at least one of the abrasive layer and the workpiece relative to the other to abrade at least a portion of the surface of the workpiece.

6. A conformable abrasive article comprising:

a backing having first and second opposed major surfaces;

an attachment system affixed to the second major surface;

a deformable material contacting a central portion of the first major surface, the deformable material having greatest thickness proximal to the center of the first major surface, wherein the deformable material consists essentially of elastomeric gel;

an elastic member affixed to the first major surface of the backing and together with the backing enclosing the deformable material; and an abrasive member affixed to the elastic member, wherein the abrasive member comprises abrasive particles and a binder.

* * * * *